US008646615B2

(12) United States Patent
Bruggencate et al.

(10) Patent No.: US 8,646,615 B2
(45) Date of Patent: Feb. 11, 2014

(54) SCREENING DISK, ROLLER, AND ROLLER SCREEN FOR SCREENING AN ORE FEED

(75) Inventors: Kyle Alan Bruggencate, Fort McMurray (CA); Paul Frederick MacDougall, Fort McMurray (CA)

(73) Assignee: Suncor Energy Inc., Calgary, Alberta (CA)

( * ) Notice: Subject to any disclaimer, the term of this patent is extended or adjusted under 35 U.S.C. 154(b) by 284 days.

(21) Appl. No.: 12/842,973

(22) Filed: Jul. 23, 2010

(65) Prior Publication Data

US 2011/0094944 A1 Apr. 28, 2011

(30) Foreign Application Priority Data

Jul. 24, 2009 (CA) ..... 2673865

(51) Int. Cl.
*B07B 13/00* (2006.01)

(52) U.S. Cl.
USPC ..... 209/667; 209/665; 209/672; 209/674; 209/668

(58) Field of Classification Search
USPC ..... 209/351, 659, 660, 662, 667
See application file for complete search history.

(56) References Cited

U.S. PATENT DOCUMENTS

| | | | | |
|---|---|---|---|---|
| 183,114 | A | | 10/1876 | Blake |
| 528,974 | A | | 11/1894 | Pike |
| 670,312 | A | | 3/1901 | Cressonnieres |
| 816,763 | A | | 4/1906 | Trask |
| 1,277,344 | A | | 8/1918 | McCargar |
| 1,399,211 | A | | 12/1921 | Hollingberry |
| 1,930,247 | A | | 10/1933 | McCormick |
| 2,138,810 | A | * | 11/1938 | Wood ..... 209/273 |
| 2,606,861 | A | | 8/1952 | Eastwood |
| 2,674,564 | A | | 4/1954 | Hermanson |
| 2,894,824 | A | | 7/1959 | Lanning |
| 3,159,562 | A | | 12/1964 | Bichard et al. |
| 3,161,483 | A | | 12/1964 | Morris |

(Continued)

FOREIGN PATENT DOCUMENTS

| | | |
|---|---|---|
| CA | 857305 | 1/1970 |
| CA | 841581 | 12/1970 |

(Continued)

OTHER PUBLICATIONS

Restriction Requirement dated Dec. 12, 2008 for U.S. Appl. No. 11/595,817.
Office Action dated Mar. 2, 2009 for U.S. Appl. No. 11/595,817.
Restriction Requirement dated Dec. 2, 2008 for U.S. Appl. No. 11/558,340.

(Continued)

*Primary Examiner* — Terrell Matthews
(74) *Attorney, Agent, or Firm* — Knobbe, Martens, Olson & Bear, LLP

(57) ABSTRACT

A screening disk for use on a roller of a roller screen for screening an ore feed is disclosed, which includes first and second opposing side working surfaces, and provisions for mounting the screening disk on a shaft of the roller. At least one of the first and second side working surfaces has a plurality of protrusions operable to extend outwardly into an interstice between the applicable side working surface and a side working surface of an adjacent mounted screening disk. A spacer may be disposed in the one interstice for confining an extent of the one interstice to a region disposed generally between the third working surface and the shaft. A screening disk may have a keyway configured to receive a key for coupling the body of the screening disk to the shaft for rotation therewith.

20 Claims, 6 Drawing Sheets

(56) References Cited

U.S. PATENT DOCUMENTS

| | | | | |
|---|---|---|---|---|
| 3,217,881 | A * | 11/1965 | Wehner | 209/330 |
| 3,260,548 | A | 7/1966 | Reichl | |
| 3,392,105 | A | 7/1968 | Poettmann et al. | |
| 3,402,896 | A | 9/1968 | Daman | |
| 3,509,641 | A | 5/1970 | Smith et al. | |
| 3,524,597 | A | 8/1970 | Burden, Jr. et al. | |
| 3,581,875 | A | 6/1971 | Guis | |
| 3,933,651 | A | 1/1976 | Erskine | |
| 3,941,425 | A | 3/1976 | Reichl | |
| 3,972,861 | A | 8/1976 | Gardner, Jr. et al. | |
| 3,998,702 | A | 12/1976 | Opoku | |
| 4,029,568 | A | 6/1977 | Pittman et al. | |
| 4,103,972 | A | 8/1978 | Kochanowsky et al. | |
| 4,120,776 | A | 10/1978 | Miller et al. | |
| 4,139,646 | A | 2/1979 | Gastrock | |
| 4,244,165 | A | 1/1981 | McElwain | |
| 4,266,676 | A | 5/1981 | Ruckstuhl et al. | |
| 4,424,113 | A | 1/1984 | Mitchell | |
| 4,486,294 | A | 12/1984 | Miller et al. | |
| 4,505,516 | A | 3/1985 | Shelton | |
| 4,505,811 | A | 3/1985 | Griffiths et al. | |
| 4,512,956 | A | 4/1985 | Robinson et al. | |
| 4,538,734 | A | 9/1985 | Gill | |
| 4,549,935 | A | 10/1985 | Tchernyak | |
| 4,585,180 | A | 4/1986 | Potts | |
| 4,658,964 | A | 4/1987 | Williams | |
| 4,733,828 | A | 3/1988 | Potts | |
| 4,741,444 | A | 5/1988 | Bielagus | |
| 4,763,845 | A | 8/1988 | Guggenheimer | |
| 4,781,331 | A | 11/1988 | Potts | |
| 4,795,036 | A | 1/1989 | Williams | |
| 4,799,627 | A | 1/1989 | Potts | |
| 4,851,123 | A | 7/1989 | Mishra | |
| 4,994,097 | A | 2/1991 | Brouwers | |
| 5,039,227 | A | 8/1991 | Leung et al. | |
| 5,117,983 | A | 6/1992 | Marrs | |
| 5,124,008 | A | 6/1992 | Rendall et al. | |
| 5,143,598 | A | 9/1992 | Graham et al. | |
| 5,232,097 | A * | 8/1993 | Tohkala | 209/234 |
| 5,555,985 | A | 9/1996 | Kobayashi | |
| 6,318,560 | B2 | 11/2001 | Davis | |
| 7,677,397 | B2 * | 3/2010 | Bjornson et al. | 209/672 |
| 8,191,714 | B2 * | 6/2012 | Kalverkamp | 209/668 |
| 2002/0018842 | A1 | 2/2002 | Dunlow | |
| 2003/0089644 | A1 | 5/2003 | Hanks | |
| 2004/0020838 | A1 * | 2/2004 | Gabl et al. | 210/232 |
| 2004/0251731 | A1 | 12/2004 | Potts | |
| 2004/0262980 | A1 | 12/2004 | Watson | |
| 2005/0051500 | A1 | 3/2005 | Price et al. | |
| 2005/0134102 | A1 | 6/2005 | Cymerman et al. | |
| 2005/0161372 | A1 | 7/2005 | Colic | |
| 2005/0173726 | A1 | 8/2005 | Potts | |
| 2006/0091249 | A1 | 5/2006 | Potts | |
| 2006/0226054 | A1 | 10/2006 | Bishop | |
| 2007/0014905 | A1 | 1/2007 | Chen et al. | |
| 2007/0095032 | A1 | 5/2007 | Nilsen et al. | |
| 2007/0180741 | A1 | 8/2007 | Bjornson et al. | |
| 2007/0180951 | A1 | 8/2007 | Armstrong et al. | |
| 2008/0047198 | A1 | 2/2008 | Mehlhose et al. | |
| 2008/0121493 | A1 | 5/2008 | Bjornson et al. | |
| 2008/0173572 | A1 | 7/2008 | Bjornson et al. | |
| 2008/0197056 | A1 | 8/2008 | Kenny | |
| 2010/0155305 | A1 | 6/2010 | Bjornson et al. | |

FOREIGN PATENT DOCUMENTS

| | | |
|---|---|---|
| CA | 890903 | 1/1972 |
| CA | 1117353 | 2/1982 |
| CA | 1126187 | 6/1982 |
| CA | 1132511 | 9/1982 |
| CA | 1137906 | 12/1982 |
| CA | 1153347 | 9/1983 |
| CA | 1163257 | 3/1984 |
| CA | 1193586 | 9/1985 |
| CA | 2116243 | 3/1993 |
| CA | 2105176 | 5/1997 |
| CA | 2164925 | 6/1997 |
| CA | 2088227 | 2/1998 |
| CA | 2294860 | 6/1998 |
| CA | 2195604 | 1/1999 |
| CA | 2217623 | 4/1999 |
| CA | 2332207 | 2/2004 |
| CA | 2352274 | 2/2004 |
| CA | 2358805 | 2/2004 |
| CA | 2436818 | 2/2004 |
| CA | 2398026 | 3/2004 |
| CA | 2440311 | 3/2005 |
| CA | 2498862 | 4/2006 |
| CA | 2506398 | 5/2006 |
| CA | 2518040 | 5/2006 |
| CA | 2520821 | 5/2006 |
| CA | 2520943 | 5/2006 |
| CA | 2558059 | 8/2006 |
| CA | 2499840 | 9/2006 |
| CA | 2499846 | 9/2006 |
| CA | 2567643 | 5/2007 |
| CA | 2567644 | 5/2007 |
| CA | 2610124 | 5/2008 |
| CA | 2610169 | 5/2008 |
| CA | 2700962 | 1/2010 |
| DE | 3936681 | 5/1990 |
| DE | 19707845 A1 | 9/1998 |
| EP | 0167178 | 4/1990 |
| EP | 0493858 | 6/1995 |
| FR | 2185027 | 5/1973 |
| GB | 1437605 | 6/1976 |
| GB | 2010777 | 7/1979 |
| GB | 04068029 | 1/2005 |
| WO | 83/00318 | 2/1983 |
| WO | 83/02071 | 6/1983 |
| WO | 00/10896 | 3/2000 |
| WO | 00/35585 | 6/2000 |
| WO | 02/092231 | 11/2002 |
| WO | 03/006165 | 1/2003 |
| WO | 03/056134 | 7/2003 |
| WO | 03/074394 | 9/2003 |
| WO | 2004/05673 | 1/2004 |

OTHER PUBLICATIONS

Office Action dated Apr. 29, 2009 for U.S. Appl. No. 11/558,340.

Restriction Requirement dated Aug. 28, 2008 for U.S. Appl. No. 11/558,303.

Office Action dated Jun. 2, 2009 for CA Patent Application No. 2476194.

Printed publication namely Screen-printed (5 pages) electronic brochure from the website of Roxon Equipment. Date display "Jan. 27, 2004" (brochure screen printed Jan. 27, 2004) along with 23 screen-printed pages from the web site for www.roxongroup.com archived by the Web Archive (http://web.archive.org).

Office Action dated Jan. 26, 2007 for U.S. Appl. No. 10/825,230.

Office Action dated Oct. 3, 2007 for U.S. Appl. No. 10/825,230.

Office Action dated Jun. 20, 2008 for U.S. Appl. No. 10/825,230.

Notice of Allowability dated May 8, 2009 for U.S. Appl. No. 10/825,230.

Coward, Julian; seminar material used as class handout, University of Alberta, Mar. 20, 2000.

Restriction Requirement dated Aug. 4, 2011 for U.S. Appl. No. 12/562,785.

Office Action dated. Oct. 21, 2011 for U.S. Appl. No. 12/562,785.

Canadian Office Action dated Jun. 7, 2013 for Canadian Application No. 2,812,219 (divisional of Canadian Application No. 2,673,865), in 3 pages.

Canadian Office Action dated May 30, 2013 for Canadian Application No. 2,812,114 (divisional of Canadian Application No. 2,673,865), in 3 pages.

Canadian Office Action dated Jun. 11, 2013 for Canadian Application No. 2,673,865, in 4 pages.

Canadian Office Action dated Jun. 11, 2013 for Canadian Application No. 2,812,125 (divisional of Canadian Application No. 2,673,865), in 3 pages.

* cited by examiner

SCREENING DISK, ROLLER, AND ROLLER SCREEN FOR SCREENING AN ORE FEED

FIELD OF THE INVENTION

This invention relates generally to screening of an ore feed using a roller screen and more particularly to a screening disk and roller for use in a roller screen for screening an ore feed.

BACKGROUND OF THE INVENTION

Surface mining operations are generally employed to excavate an ore deposit that is found near the surface of an ore body. Such ore deposits are usually covered by an overburden of rock, soil, and/or plant matter, which may be removed prior to commencing mining operations. The remaining ore deposit may then be excavated and transported to a plant for processing to remove commercially useful products. The ore deposit may comprise an oil sand deposit from which hydrocarbon products may be extracted, for example.

In general, the excavated ore will include sized ore portions having a size suitable for processing and oversize ore portions that are too large for processing. Separation of the oversize ore portions from sized ore portions may be performed by screening the excavated ore through a screen mesh having openings sized to permit passage of sized ore portions through the screen while preventing oversize ore portions from passing through the screen. The oversize ore portions may be discarded and/or crushed to produce sized ore. One problem associated with such screening is that the screen mesh is prone to blockage.

Roller screens have also been used to screen ore. The roller screen has a plurality of adjacently located rollers, each roller having a plurality of screening disks mounted in spaced apart relation on a shaft. The screening disks intermesh with screening disks on an adjacent roller of the roller screen to define interstices for permitting passage of sized ore portions through the roller screen. The rollers are coupled to a rotational drive to cause the rollers to rotate, thereby clearing blockages that may occur while screening the ore.

In the example of an oil sand ore deposit, such as the Northern Alberta oil sands, the ore deposit comprises about 70 to about 90 percent by weight of mineral solids including sand and clay, about 1 to about 10 percent by weight of water, and a bitumen or oil film. The bitumen may be present in amounts ranging from a trace amount up to as much as 20 percent by weight. Due to the highly viscous nature of bitumen, when excavated some of the ore may remain as clumps of oversize ore that requires sizing to produce a sized ore feed suitable for processing. Due to the northerly geographic location of many oil sands deposits, the ore may also be frozen making sizing of the ore more difficult.

SUMMARY OF THE INVENTION

In accordance with one aspect of the invention there is provided a screening disk for use on a roller of a roller screen for screening an ore feed, the roller screen having a plurality of adjacently located rollers, each adjacently located roller having a plurality of screening disks mounted in spaced apart relation on a shaft, the mounted screening disks being operable to intermesh with mounted screening disks on an adjacent roller of the roller screen to define interstices between respective mounted screening disks for permitting passage of sized ore portions through the roller screen. The screening disk includes first and second opposing side working surfaces, and provisions for mounting the screening disk on a shaft of the roller for rotation therewith. At least one of the first and second side working surfaces has a plurality of protrusions operable to extend outwardly into an interstice between the at least one side working surface and a side working surface of an adjacent mounted screening disk, the protrusions being operable to prevent oversize portions of ore passing through the interstice between the intermeshing screening disks.

The protrusions each have a generally cylindrical shape.

Each protrusion of the plurality of protrusions may be dimensioned to provide sufficient clearance distance between the protrusion and the side working surface of the adjacent mounted screening disk to prevent contact between the protrusion and the side working surface when operating the roller screen.

The interstice between the at least one side working surface and the side working surface of the adjacent mounted screening disk may have a dimension of about 60 millimeters and the clearance distance is in the range of about 10 millimeters.

Each protrusion may be removably secured to the screening disk to facilitate replacement of the protrusion.

The plurality of protrusions may be disposed in spaced apart relation on the at least one side working surface.

The plurality of protrusions may include a first plurality of protrusions disposed in spaced apart relation about a center of the at least one side working surface.

The first plurality of protrusions may be disposed at a first radial distance from the center of the at least one side working surface and may further include a second plurality of protrusions disposed in spaced apart relation about the center of the at least one side working surface, the second plurality of protrusions being disposed at a second radial distance from the center of the at least one side working surface.

Each of the first and second opposing side working surfaces may include plurality of protrusions extending outwardly therefrom.

The screening disk may include a third working surface extending between the first and second side working surfaces, the third working surface being operable to define an interstice between the third working surface and a shaft of an adjacent roller when mounted in the roller screen.

The third working surface may include at least one removable cap disposed circumferentially on the screening disk.

The screening disk may include an opening bored through the screening disk between the first and second opposing side working surfaces, the opening being operable to receive a first fastener having a first threaded portion operable to receive a threaded portion of a second fastener for securing the at least one removable cap to the screening disk.

The provisions for mounting the screening disk on a shaft may include a centrally located opening extending between the first and second opposing side working surfaces of the screening disk, the opening being operably configured to permit the screening disk to be received on the shaft and to engage the shaft for rotation therewith.

In accordance with another aspect of the invention there is provided a roller for use in a roller screen for screening an ore feed. The roller includes a shaft, and a plurality of screening disks mounted in spaced apart relation on the shaft. The screening disks are operable to intermesh with mounted screening disks on an adjacent roller of the roller screen to define interstices between respective mounted screening disks for permitting passage of sized ore portions through the roller screen. At least one of the plurality of screening disks on the shaft includes a screening disk as claimed above.

In accordance with another aspect of the invention there is provided a roller screen for screening an ore feed. The roller screen includes a plurality of adjacently located rollers. Each roller includes a shaft having a plurality of screening disks mounted in spaced apart relation on the shaft the mounted screening disks being operable to intermesh with mounted screening disks on an adjacent roller of the roller screen to define interstices between respective mounted screening disks for permitting passage of sized ore portions through the roller screen. At least one of the screening disks on at least one of the rollers includes a screening disk as claimed above.

Each of the screening disks on the at least one roller may include a protrusion extending outwardly from each of the first and the second side working surfaces and an adjacent roller to the at least one of the adjacently located rollers may include a plurality of screening disks that do not include protrusions.

In accordance with another aspect of the invention there is provided a roller screen for screening an ore feed. The roller screen includes a plurality of adjacently located rollers, each adjacently located roller including a shaft and having a plurality of screening disks mounted in spaced apart relation on the shaft, the mounted screening disks being operable to intermesh with mounted screening disks on an adjacent roller of the roller screen to define interstices between respective mounted screening disks for permitting passage of sized ore portions through the roller screen. Each screening disk includes first and second opposing side working surfaces and a third working surface extending between the first and second side working surfaces. One interstice of the plurality of interstices being defined extending outwardly from a shaft of an adjacently located roller toward the third working surface. The roller screen also includes at least one spacer disposed in the one interstice for confining an extent of the one interstice to a region disposed generally between the third working surface and the shaft, the at least one spacer being operable to prevent oversize ore portions from passing through the one interstice.

The at least one spacer may include an annular spacer disposed in the one interstice.

The annular spacer may be supported on the shaft and disposed adjacent to one of the side working surfaces of the screening disk.

The annular spacer may be connected to one of the side working surfaces of the screening disk and extends outwardly therefrom into the one interstice.

The at least one annular spacer may include a first annular spacer disposed adjacent to the first side working surface of a first screening disk, and a second annular spacer disposed adjacent to the second side working surface of a second screening disk located on the shaft adjacent to the first screening disk.

In accordance with another aspect of the invention there is provided a roller screen for screening an ore feed. The roller screen includes a plurality of adjacently located rollers, each adjacently located roller including a shaft and having a plurality of screening disks mounted in spaced apart relation on the shaft, the mounted screening disks being operable to intermesh with mounted screening disks on an adjacent roller of the roller screen to define interstices between respective mounted screening disks for permitting passage of sized ore portions through the roller screen. Each screening disk includes first and second opposing side working surfaces and a third working surface extending between the first and second side working surfaces. One interstice of the plurality of interstices is defined extending outwardly from a shaft of an adjacently located roller toward the third working surface. The roller screen also includes provisions for restricting an extent of the one interstice to a region disposed generally between the third working surface and the shaft, the provisions for restricting being operable to prevent oversize ore portions from passing through the one interstice.

In accordance with another aspect of the invention there is provided a screening disk for use on a roller of a roller screen for screening an ore feed, the roller screen having a plurality of adjacently located rollers, each adjacently located roller having a plurality of screening disks mounted in spaced apart relation on a shaft, the mounted screening disks being operable to intermesh with mounted screening disks on an adjacent roller of the roller screen to define interstices between respective mounted screening disks for permitting passage of sized ore portions through the roller screen. The screening disk includes a body having first and second opposing side working surfaces, a centrally located opening extending between the first and second opposing side working surfaces for engaging the shaft, and at least one keyway formed in the opening. The keyway is operably configured to receive a key for coupling the body of the screening disk to the shaft for rotation therewith.

In accordance with another aspect of the invention there is provided a screening disk for use on a roller of a roller screen for screening an ore feed, the roller screen having a plurality of adjacently located rollers, each adjacently located roller having a plurality of screening disks mounted in spaced apart relation on a shaft, the mounted screening disks being operable to intermesh with mounted screening disks on an adjacent roller of the roller screen to define interstices between respective mounted screening disks for permitting passage of sized ore portions through the roller screen. The screening disk includes at least two separable body portions, the separable body portions together defining an opening for engaging the shaft, the opening having at least one generally planar portion for engaging a corresponding planar portion of the shaft for coupling the screening disk to the shaft for rotation therewith. The screening disk further comprises provisions for removably securing the separable body portions of the screening disk on the shaft.

The screening disk may include first and second opposing side working surfaces and a third working surface extending between the first and second side working surfaces and the third working surface may include a removable cap disposed circumferentially on the screening disk and the securing provisions may include provisions for fastening the removable cap to the screening disk such that the cap may be operable to secure the separable body portions of the screening disk on the shaft.

The provisions for fastening the removable cap may include at least one fastener operable to secure a first end of the cap to a first separable body portion, and at least one fastener operable to secure a second end of the cap to a second separable body portion.

The opening may have a generally square cross sectional shape and the shaft may have a corresponding generally square cross section for receiving the screening disk.

In accordance with another aspect of the invention there is provided a screening disk for use on a roller of a roller screen for screening an ore feed, the roller screen having a plurality of adjacently located rollers, each adjacently located roller having a plurality of screening disks mounted in spaced apart relation on a shaft, the mounted screening disks being operable to intermesh with mounted screening disks on an adjacent roller of the roller screen to define interstices between respective mounted screening disks for permitting passage of sized ore portions through the roller screen, the screening disk. The screening disk includes a generally cylindrical body portion having first and second opposing side working surfaces, and provisions for engaging the shaft for rotation therewith. The screening disk also includes a third working surface extending across the screening disk between the first and second side working surfaces, the third working surface having a plurality of teeth, each tooth having a tooth face and a tooth back, the tooth back extending between adjacent tooth faces of the plurality of teeth and the tooth face being operably configured to fragment the ore feed to produce ore portions that are sized for passage through the interstices, the tooth face having wear resistant working surface.

The wear resistant working surface on the tooth face may include a wear resistant overlay selectively applied to the tooth face.

The wear resistant overlay material may include one of tungsten carbide and chromium carbide.

In accordance with another aspect of the invention there is provided a screening disk for use on a roller of a roller screen for screening an ore feed, the roller screen having a plurality of adjacently located rollers, each adjacently located roller having a plurality of screening disks mounted in spaced apart relation on a shaft, the mounted screening disks being operable to intermesh with mounted screening disks on an adjacent roller of the roller screen to define interstices between respective mounted screening disks for permitting passage of sized ore portions through the roller screen, the screening disk. The screening disk includes a generally cylindrical body having first and second opposing side working surfaces, provisions for engaging the shaft for rotation therewith, and a removable cap disposed circumferentially on the screening disk and extending across the screening disk between the first and second side working surfaces, the cap includes an outwardly oriented wear resistant working surface.

The cap may include white iron.

The wear resistant working surface may include a wear resistant overlay material disposed on the cap.

The wear resistant overlay material may include one of tungsten carbide and chromium carbide.

The cap may include a plurality of teeth, each tooth having a tooth face and a tooth back, the tooth back extending between adjacent tooth faces of the plurality of teeth and the tooth face being operably configured to fragment the ore feed to produce ore portions that may be sized for passage through the interstices, the wear resistant overlay material being selectively applied to the tooth face.

The cap may have a width dimension across the screening disk of at least 75 millimeters.

The screening disk may include a protrusion located on one of an inner surface of the cap and an outer circumferential surface of the body, and a corresponding recess located on the other of the inner surface of the cap and the outer circumferential surface of the body, the protrusion being operable to engage the recess when the cap is mounted on the screening disk, the protrusion being operable to transmit a rotational torque from the body to the cap.

Each of the inner surface of the cap and the outer circumferential surface of the body may include a recess portion and the protrusion may include a removable key.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
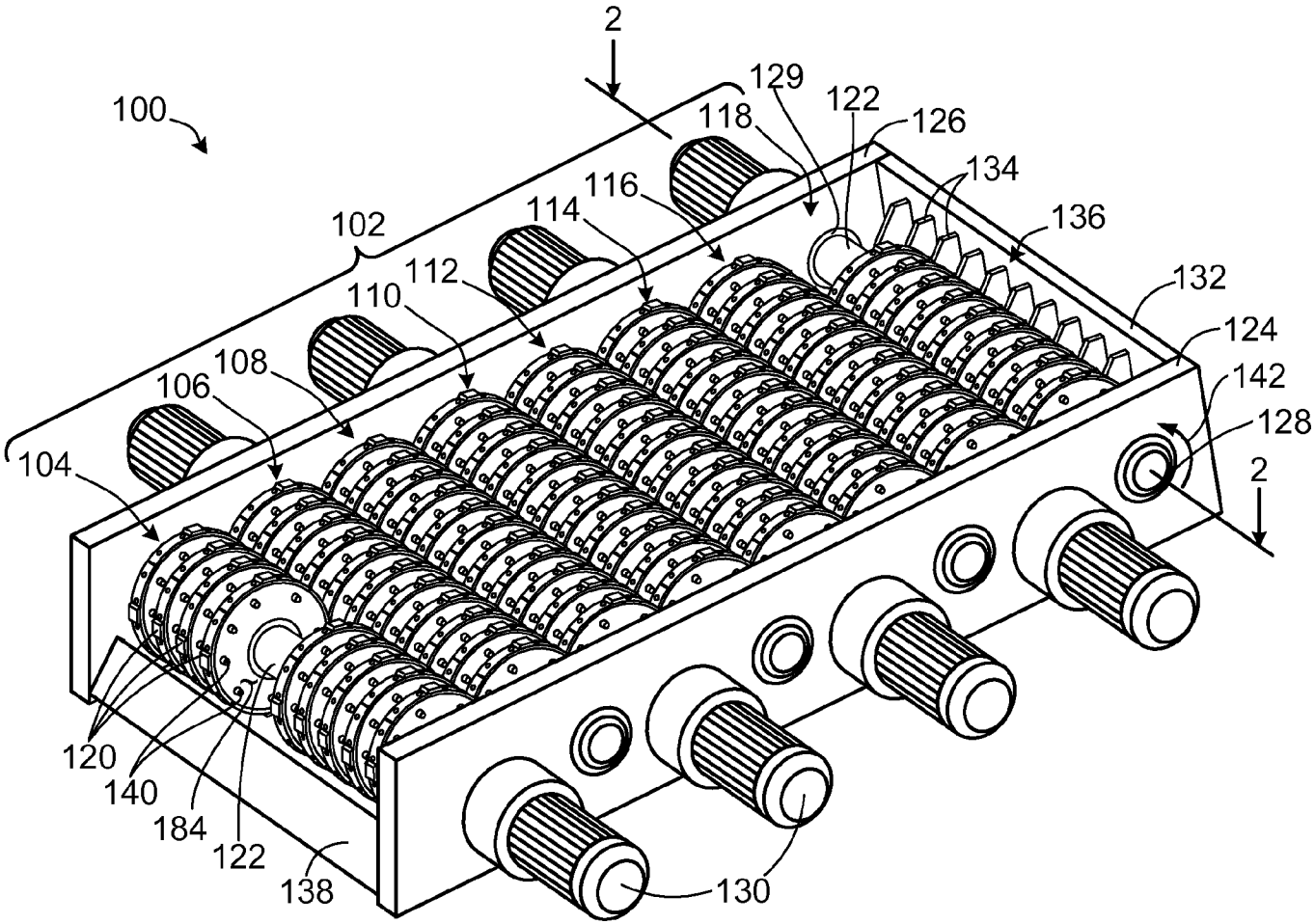
FIG. 1 is a perspective view of a roller screen in accordance with a first embodiment of the invention.

Referring to FIG. 1, a roller screen for screening an ore feed is shown generally at 100. The roller screen 100 includes first and second sidewalls 124 and 126 and an end wall 132, located at a first end of the roller screen 100. The end wall 132 extends between the sidewalls 124 and 126. The roller screen 100 also includes a discharge ramp 138 located at a second end of the roller screen 100. The discharge ramp 138 also extends between the first and second sidewalls 124 and 126.

The roller screen 100 further includes a plurality of adjacently located rollers 102. In the embodiment shown the roller screen 100 includes eight rollers 104 to 118, but other embodiments may include additional rollers or fewer rollers than shown in FIG. 1. Each roller includes a shaft 122 which is mounted for rotation in bearings 128 and 129, the bearings being located in the respective sidewalls 124 and 126. In one embodiment the bearing may comprise a labyrinth seal to prevent ingress of contaminants, which may cause premature failure of the bearings. In FIG. 1, two of the screening disks on the roller 118 have been omitted to reveal the shaft 122 and the bearing 129. Similarly, two of the screening disks on the roller 104 have been omitted to reveal the shaft 122.

The roller screen 100 further includes a drive motor 130 associated with each of the rollers 102 for supplying a rotational torque to the respective shafts 122 of the roller. In the embodiment shown in FIG. 1, each roller 102 has an associated drive motor 130, but in other embodiments a single drive motor may be coupled more than one roller for providing a drive torque to more than one roller.

Each roller 102 further includes a plurality of screening disks 120 mounted in spaced apart relation on the shaft 122. The mounted screening disks 120 intermesh with mounted screening disks on an adjacent roller. For example, the mounted screening disks 120 on the roller 104 intermesh with mounted screening disks on the adjacent roller 106. The end wall 132 also includes a plurality of static plates 134, which extend outwardly from the end wall and intermesh with the screening disks 120. The intermeshing screening disks 120 and static plates 134 define a plurality of interstices therebetween for permitting passage of sized ore portions through the roller screen 100. In general, the spacing between screening disks 120 defines dimensions of the interstices, which in turn determines a passing size for the roller screen 100. In one embodiment where an oil sand ore feed is to be processed, the desired passing size is about 60 mm by about 60 mm by about 100 mm. In other embodiments the passing size may be larger or smaller on one or more dimensions.

Figure 2:
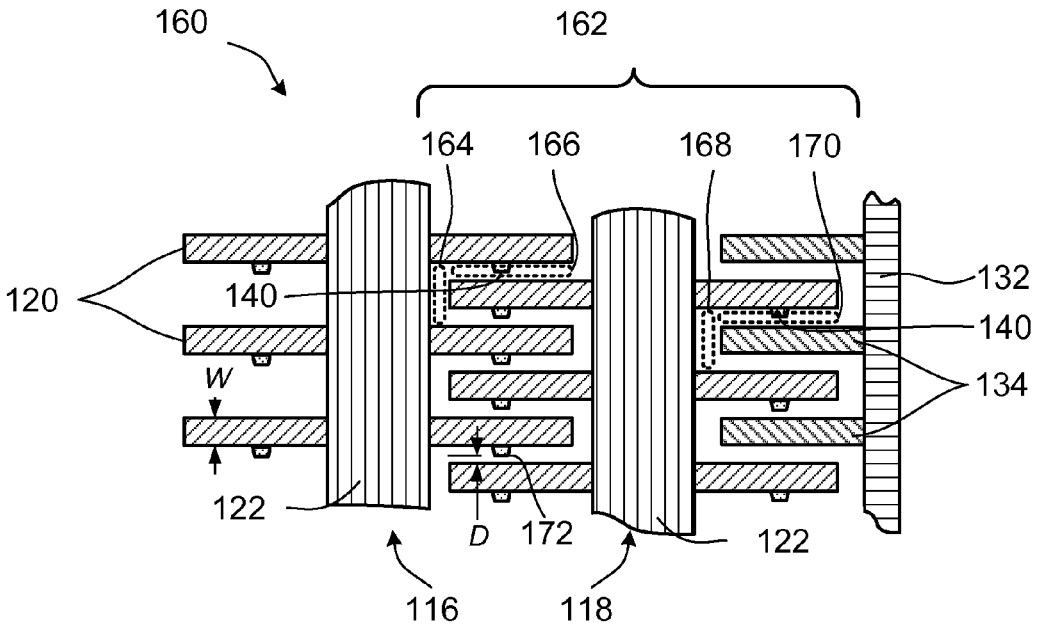
FIG. 2 is a cross sectional view of a portion of the roller screen shown in FIG. 1 taken along the line 2-2.

In the embodiment shown, each screening disk 120 includes plurality of protrusions 140 extending outwardly from a side working surface 184 of the screening disk. Portions of the rollers 116 and 118 of the roller screen 100 are shown in sectional view in FIG. 2 at 160. Referring to FIG. 2, the intermeshing disks 120 define interstices 162 (shown in broken outline) including an interstice 164 between the screening disk 120 and the shaft 122, and an interstice 166 between adjacent screening disks. The protrusion 140 effectively divides the interstice 166 into two smaller interstices, thereby preventing elongate oversize portions of ore from passing through the interstice. Similarly, the plurality of static plates 134 further define interstices 168 and 170 between the static plates 134 and the screening disks 120, and a respective protrusion 140 divides the interstice 170 into two smaller interstices.

In operation, an ore feed including some sized ore portions and some oversize ore portions, is received at an input end 136 of the roller screen 100. The sized ore portions have passing size dimensions that should permit passage through the interstices 160, while the oversize ore portions have at least one dimension too large to permit passage through the interstices. In one operational embodiment, each of the rollers 102 are rotated in a direction shown by the arrow 142 to cause the ore feed to be transported along the roller screen from the input end 136 to the discharge ramp 138. While the ore feed is being transported, sized ore portions are able to pass through the interstices 160 and fall through the roller screen 100. In general the roller screen is disposed over a container (not shown) that receives the sized ore portions for further processing. Oversize ore portions are generally prevented from passing through the interstices 160, unless in the process of being transported, the action of the screening disks 120 causes the oversize ore portions to be fragmented into sized ore portions. In general, the screening rollers 102 of the roller screen 100 provide some sizing action resulting in fragmentation of some oversize ore portions into ore portions of passing size.

Oversize ore portions that reach the discharge ramp 138 are discharged from the roller screen 100 and may be further sized in a separate process or may be discarded. Alternatively, as disclosed in Canadian Patent application CA2640514 filed on Oct. 7, 2008 and entitled "Method and Apparatus for Processing an Ore Feed", additional opposing sizing rollers may be included to cause the oversize ore portions in the ore feed to be sized while being transported along the roller screen.

Figure 3:
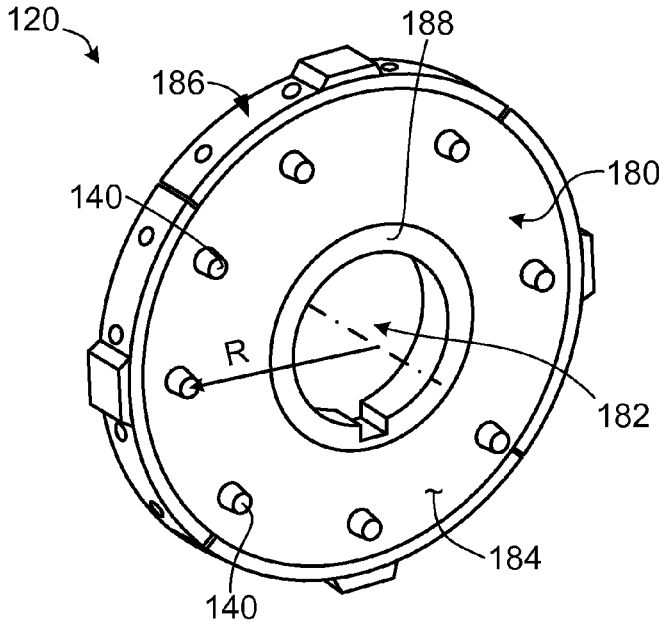
FIG. 3 is a perspective view of a screening disk used in the roller screen shown in FIG. 1.

The screening disk 120 is shown in greater detail in FIG. 3. Referring to FIG. 3, the screening disk 120 includes a body portion 180 having a centrally located opening 182 for mounting the screening disk on the shaft 122 (shown in FIG. 1). In the embodiment shown, the centrally located opening 182 is defined by a mounting hub 188, which may be welded to the body portion 180. The body portion 180 defines a first side working surface 184. A second side working surface (not shown in FIG. 3) is defined on an opposite side of the body portion 180. The screening disk 120 further includes a third working surface 186 extending between the first and second side working surfaces.

Figure 7:
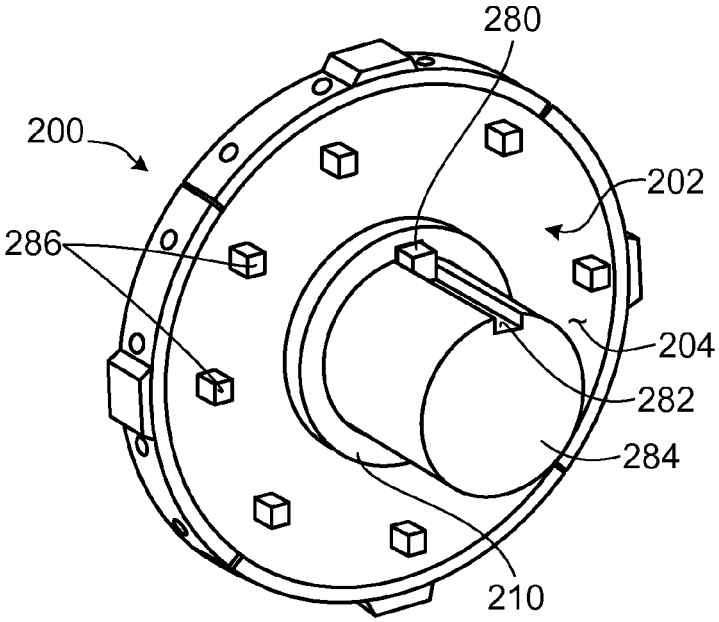
FIG. 7 is a perspective view of a screening disk in accordance with yet another embodiment of the invention.

In the embodiment shown in FIG. 3, the protrusions 140 have a truncated conical shape. In other embodiments the protrusions may have a cylindrical shaped or a generally cubic shape (as shown in FIG. 7). The protrusions 140 are disposed in uniform spaced apart relation about a center of the first side working surface 194, each protrusion being spaced a distance R from the center of the first side working surface 184. Referring back to FIG. 2, the protrusions 140 are dimensioned to provide an operational clearance distance D between an extent 172 of the protrusion 140 and the adjacent screening disk. In general the clearance D is selected to provide sufficient clearance to prevent contact between the extent 172 and a side working surface of the adjacent screening disk, during operation of the roller screen 100. In one embodiment a width W of the screening disk 120 may be about 75 mm, the distance between side working surfaces of adjacent screening disks may be about 50 mm or between about 50 mm and about 60 mm, and the clearance distance D may be about 10 mm or more. In other embodiments the distance between side working surfaces of adjacent screening disks may be larger.

For example, in another embodiment, the distance between side working surfaces may be about 60 mm to about 100 mm to provide yet further spacing when working with suitable feed material or when the feed material will be further processed downstream with a further or secondary sizer. In yet another embodiment, the distance between side working surfaces may be greater than 100 mm to provide yet further spacing. For instance, in yet another embodiment, the distance between side working surfaces may be about 100 mm to about 150 mm.

Figure 4:
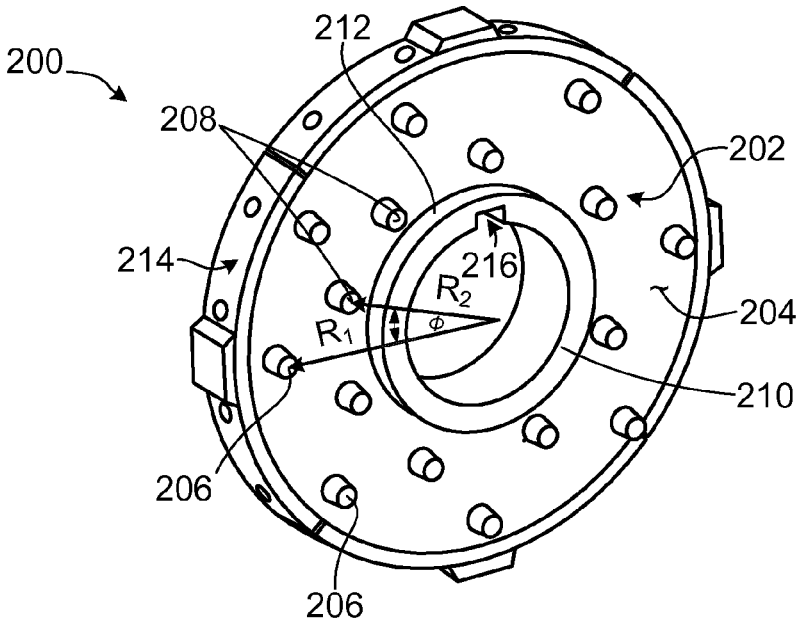
FIG. 4 is a perspective view of a screening disk in accordance with an alternative embodiment of the invention.

Referring now to FIG. 4, a screening disk in accordance with an alternative embodiment of the invention is shown generally at 200. The screening disk 200 includes a body portion 202, defining a first side working surface 204. The screening disk 200 includes a first plurality of protrusions 206, which are spaced apart about a center of the first side working surface 204. Each of the first plurality of protrusions 206 are located a distance $R_1$ from the center of the side working surface 204. The screening disk 200 further includes a second plurality of protrusions 208, which are spaced apart about a center of the first side working surface 204. Each of the second plurality of protrusions 206 are located a distance $R_2$ from the center of the side working surface 204. In this embodiment the first plurality of protrusions 206 are also angularly offset from the second plurality of protrusions 208 by an angle $\phi$. However, in other embodiments members of each of the first and second plurality of protrusions may be radially aligned (i.e. $\phi$=0 degrees). The screening disk 200 further includes a third working surface 214 extending between the first and second side working surfaces.

Still referring to FIG. 4, the screening disk 120 also includes a mounting hub 210, which may welded to the body portion 202 for example. The mounting hub 210 includes a spacer portion 212, which extends outwardly from the first side working surface 204. Accordingly, in this embodiment the spacer portion 212 has a generally annular shape.

Figure 5:
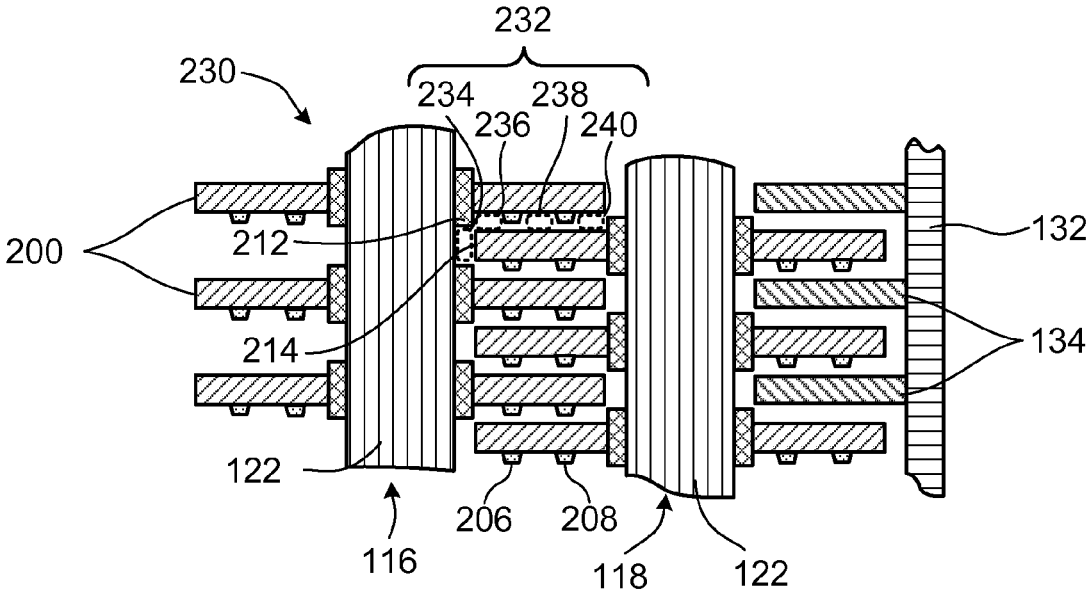
FIG. 5 is a cross sectional view of a portion of a roller screen incorporating the screening disk shown in FIG. 4.

A portion of a roller screen having screening disks in accordance with the embodiment shown in FIG. 4 is shown generally in FIG. 5 at 230. Referring to FIG. 5, the first and second plurality of protrusions 206 and 208 on the intermeshing screening disks 200, and the spacer portions 212 define a plurality of interstices 232 between adjacent screening disks. The interstices 232 include a first interstice 234, which is confined in extent by the spacers 212 to a region between the third working surface 214 and the shaft 122. Advantageously, the spacers 212 prevent oversize ore portions from passing through the first interstice 234. The interstices 232 further include, a second interstice 236 between the spacer 212 and the protrusion 206, a third interstice 238 between the protrusions 206 and 208, and a fourth interstice 240 between the protrusion 208 and the spacer 212 located on the shaft 122 of the adjacent roller 118. Advantageously, the radii $R_1$ and $R_2$ are selected to cause the second, third, and fourth interstices 234, 236, and 238 to prevent oversize ore portions from passing through the respective interstices, while passing ore portions of passing size.

Various other configurations of protrusions and spacers are possible. For example, as shown in top view in FIG. 6, a screening disk 250 has a first side working surface 252 and a second side working surface 254. The screening disk 250 includes protrusions 256 located on the first side working surface 252 at a radius $R_2$ from the center and protrusions 258 located on the second side working surface 254 at a radius $R_1$ from the center. Referring back to FIG. 1, in other embodiments screening disks on alternating rollers (for example the rollers 104, 108, 112, and 106) may include protrusions located on each of the first and second side working surfaces while the remaining rollers (i.e. rollers 106, 110, 114, and 118) may not include protrusions.

Figure 6:
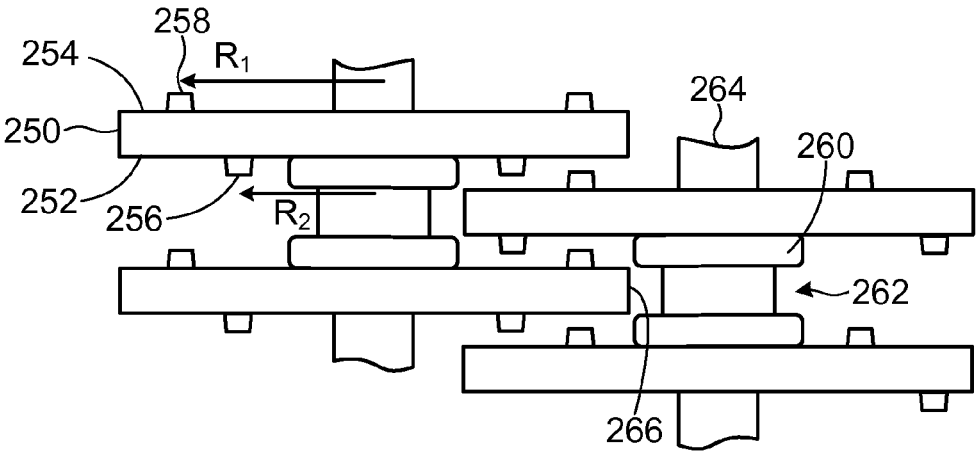
FIG. 6 is a top view of a portion of a roller screen including a screening disk in accordance with another embodiment of the invention.

An alternative embodiment of a spacer 260 is also shown in FIG. 6. The spacer 260 has a generally cylindrical shape with an internal bore (not shown) sized to be received on a shaft 264 between the spaced apart screening disks 250. The spacer 260 includes a centrally located recess 262. When assembled on a roller, the spacer 26 is disposed in-between adjacent screening disks 250 and is operable to confine an extent of an interstitial region between a third working surface 266 of the screening disk 250 and the shaft 264, as described above in connection with FIG. 5.

Referring back to FIG. 4 in the embodiment shown, the hub 210 of the screening disk 200 includes a keyway recess 216 for receiving a key for coupling the screening disk 200 to the shaft 122. Referring to FIG. 7, the screening disk 200 is shown mounted on a shaft 284, which includes a keyway recess 282 corresponding to the keyway recess 216 on the hub 210. When mounting the screening disk 200 on the shaft 122, the corresponding keyway recesses 216 and 282 are aligned and a key 280 is inserted into the keyway. Advantageously, the key 280 and keyway recesses 216 and 282 are toleranced to provide a loose sliding fit between the surfaces of the key and the keyway to prevent ingress of sand or other abrasive materials, which could cause failure of the coupling, between the disk 200 and the shaft 284. In the embodiment shown in FIG. 7, the screening disk 200 has protrusions 286 having a generally cubic shape in place of the truncated conical shaped protrusions shown in other embodiments.

Figure 8:
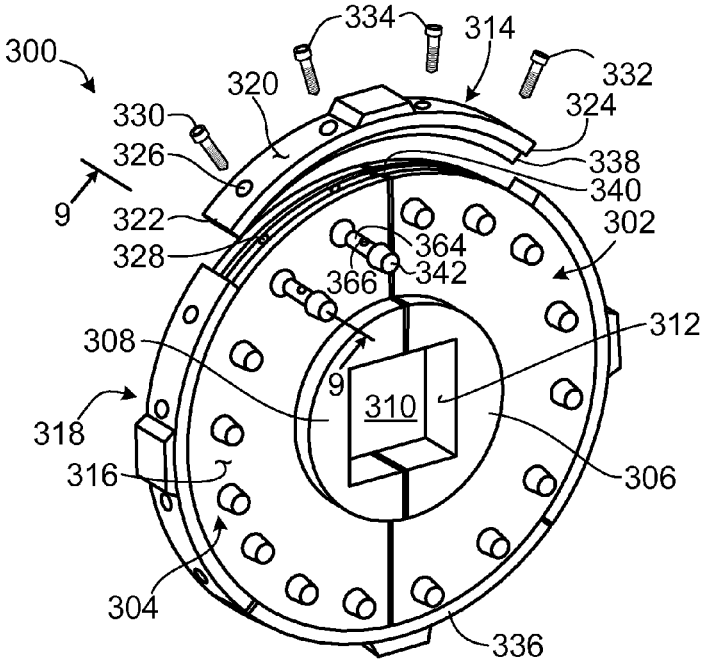
FIG. 8 is a perspective exploded view of a screening disk in accordance with a further embodiment of the invention.

Referring now to FIG. 8, an alternative embodiment of a screening disk for use in the roller screen 100 is shown generally at 300. The screening disk 300 includes first and second separable body portions 302 and 304. The first body portion 302 includes a first mounting hub portion 306 attached to the first body portion and the second body portion 304 includes a second mounting hub portion 308 attached to the second body portion and 304. Together, the first and second mounting hub portions 306 and 308 define an opening 310 having at least one planar portion 312 for engaging a corresponding planar portion of a shaft (not shown). In the embodiment shown in FIG. 8, the opening 310 has a generally square opening for mounting on a shaft having a corresponding square cross section.

The body portions 302 and 304 together form first and second opposing side working surfaces 316 and 318. A third working surface 320 is provided by a removable cap 314 extending across the screening disk between the first and second side working surfaces 316 and 318. In the embodiment shown, four such removable caps are provided to define a third working surface extending around a circumference of the screening disk 300.

The removable cap 314 has a first end 322 and a second end 324. The first end 322 includes a through opening 326 for receiving a first fastener 330. The second body portion 304 also includes an opening 328, which is aligned with the opening 326 for receiving the first fastener 330 for securing the first end of the removable cap 314 to the second body portion 304. Similarly, the second end 324 includes a through opening for receiving a second fastener 332 for securing the second end of the removable cap 314 to the first body portion 302. In the embodiment shown, further openings are provided in the removable cap 314 for receiving further fasteners 334 for securing the cap to the first and second body portions. The removable cap 314 further includes a protruding channel portion 338 for engaging corresponding channel portions 340 in the body portions 302 and 304. In other embodiments, the protruding channel may be provided on the body portions 304 and 304, and the removable cap 314 may include a corresponding channel for receiving the protruding channel portion.

When mounting the screening disk 300, the first and second body portions 302 and 304 are separately mounted on the shaft and the respective first and second ends 322 and 324 of the removable cap 314 are secured to the respective first and second body portions 302 and 304. Similarly, the first and second ends of an oppositely located removable cap 336 are secured to the respective first and second body portions 302 and 304, thereby securing the screening disk 300 on the shaft. The channel portion 338 acts to locate the cap 314 on the body portion and to prevent lateral movement of the cap during operation of the roller screen.

Figure 9:
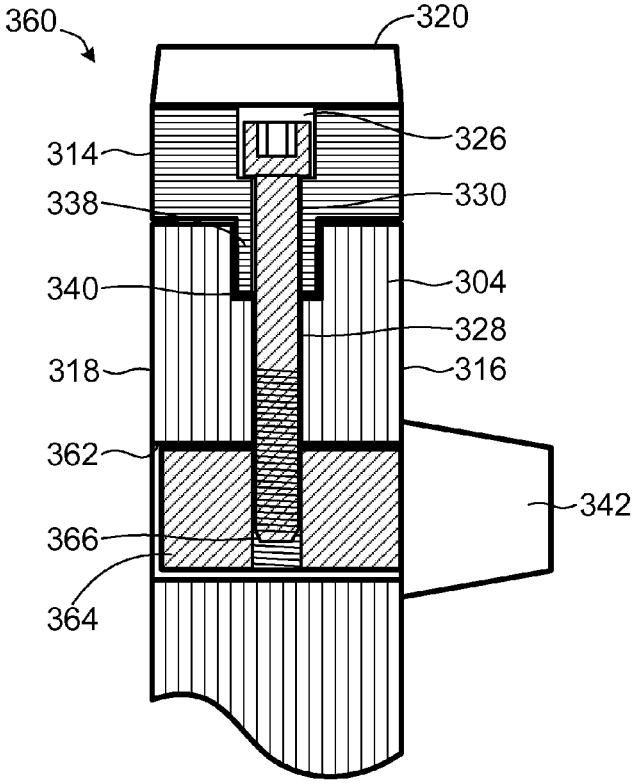
FIG. 9 is a cross sectional view of a portion of the screening disk shown in FIG. 8 taken along the line 9-9.

Referring to FIG. 9, the removable cap 314 and a portion of the second body portion 304 of the screening disk 300 is shown in cross section at 360. The channel portion 338 of the removable cap 314 is shown located in the corresponding channel portion 340 of the second body portion 304. The second body portion 304 further includes a through opening 362, extending through the body portion between the first and second working surfaces 316 and 318. The opening 328 extends between the channel portion 340 and the through opening 362. The through opening 362 is dimensioned to receive a dowel pin 364. The dowel pin 364 has a threaded portion 366 for receiving a threaded portion of the fastener 330 for securing the cap 314 to the second body portion. Advantageously, should the dowel pin 364 require replacement, it is a relatively simple matter to drive out a damaged dowel pin 364 and insert a replacement. Referring back to FIG. 8, in the embodiment shown each dowel pin 364 includes a protrusion 342, the dowel pin and protrusion forming a unitary body. In other embodiments the protrusions may be welded or otherwise attached to the sides of the screening disk.

Advantageously, the screening disk 300 facilitates replacement of a damaged or worn screening disk on a roller in-situ, since the damaged disk may be removed without removing the roller from the roller screen 100. The rollers are extremely heavy and require specialized rigging equipment for removal, to permit access to the shaft, and thus in-situ disk replacement represents a substantial serviceability improvement. The removable protrusions 342 further permit replacement of worm protrusions on a screening disk.

Figure 10:
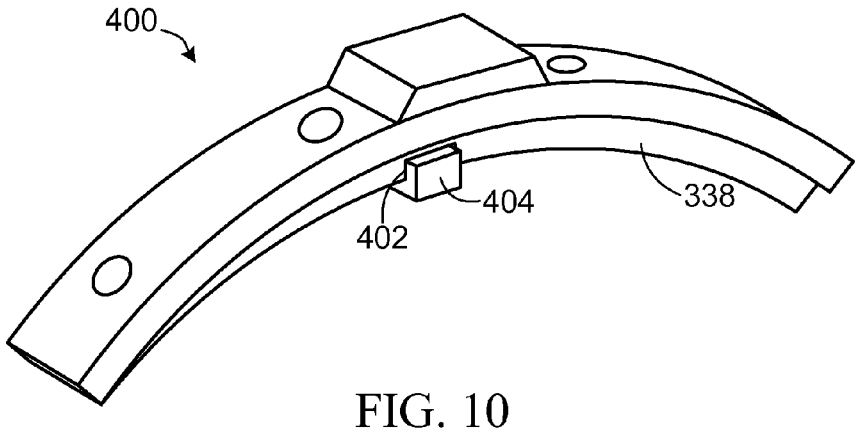
FIG. 10 is a perspective view of a removable cap in accordance with another alternative embodiment of the invention.

Referring now to FIG. 10, a removable cap in accordance with an alternative embodiment is shown generally at 400. The removable cap 400 includes a transverse keyway 402 in channel portion 338 for receiving a key 404 for transmitting a torque from the body portion of the screening disk to the cap. In this embodiment, the screening disk has a corresponding transverse keyway (not shown). Advantageously, by transmitting a substantial portion of the torque through the key 404, the fasteners 330, 332, and 334 shown in FIG. 8 are subjected to reduced shearing stress thereby preventing potential failure of the fasteners. In other embodiments, the key 404 may be integrally formed in the replaceable cap 400.

Figure 12:
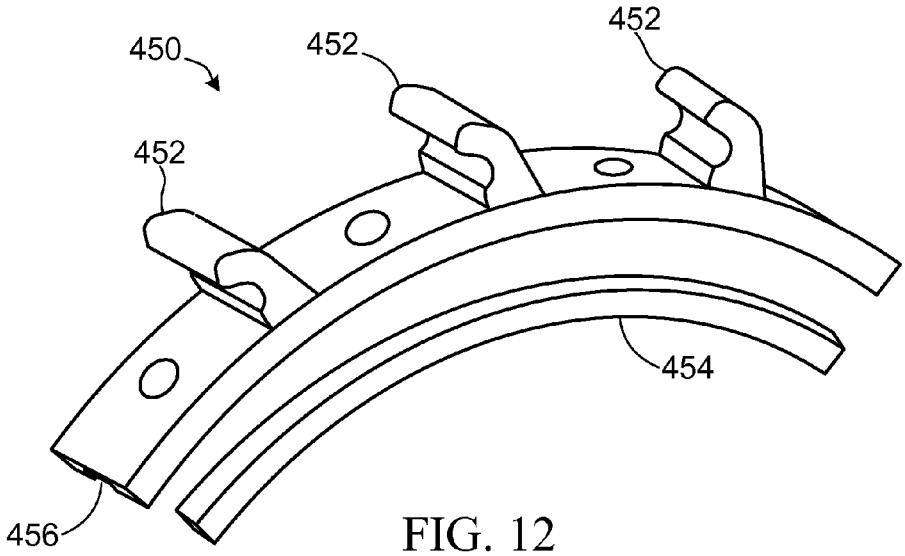
FIG. 12 is a perspective view of a removable cap in accordance with yet another embodiment of the invention.

Referring to FIG. 12, a removable cap according to yet anther embodiment is shown generally at 450. The removable cap 450 in this embodiment includes three hook-shaped teeth 452 for gripping ore portions while screening the ore feed. The teeth 452 may be included to facilitate some sizing action for reducing the size of oversize ore portions in the ore feed. Advantageously, removable caps with a variety of different shaped teeth may be fabricated to permit configuration of the screening disks for screening of a particular ore feed. The removable cap 450 also differs from the removable cap 314 in that the protruding channel portion 338 has been omitted in favor of a circumferential key 454, which is received in a channel 456 in the cap and engages the corresponding channel portion 340 (shown in FIG. 8).

The removable cap 400 may be fabricated by a casting process, and in one embodiment may be cast from white iron. Cast white iron is extremely hardwearing and is preferably cast into a final shape, since machining is generally limited to grinding operations. In embodiments where the removable cap 400 is fabricated from cast white iron, tolerances of the screening disk receiving the cap should take into account the variability of the casting process. The inventors have further found that when the width W of the disk (as defined in FIG. 2) is too small, the required size of the fasteners 330, 332, and 334 (shown in FIG. 8) causes the cap 400 to be prone to cracking. Accordingly, Applicant has determined that white iron castings, the cap width W should preferably be greater than about 75 mm. Advantageously, when the cap 400 is cast from white iron, the entire cap is extremely wear resistant due to the distributed chromium carbides in the bulk material of the cap.

Figure 11:
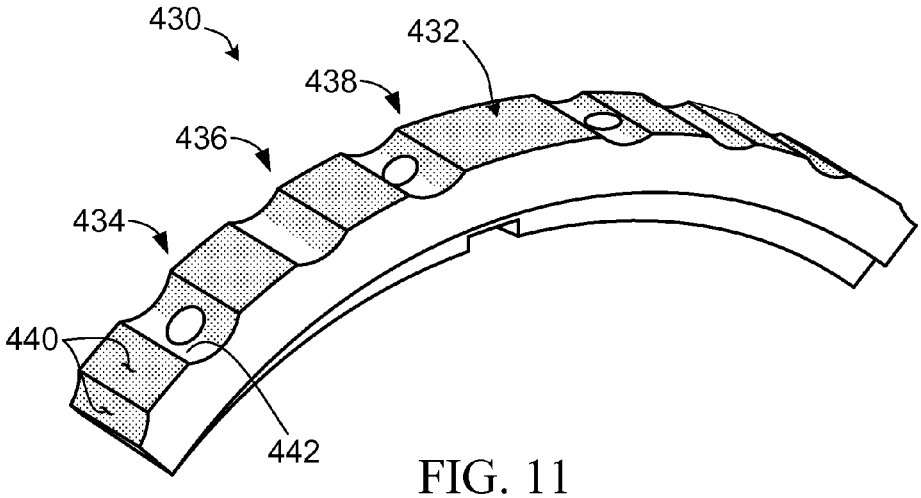
FIG. 11 is a perspective view of a removable cap in accordance with further alternative embodiment of the invention.

Referring to FIG. 11, a removable cap in accordance with another embodiment of the invention is shown generally at 430. In this embodiment, the removable cap 430 has a different working surface 432 to the cap 400 shown in FIG. 10. Specifically the working surface 432 comprises a plurality of teeth (434 to 438), each tooth having a tooth face 440, and a tooth back 442. The tooth face 440 is defined by an intended direction of rotation of the cap 430 when in operation. In this embodiment, the cap 430 is fabricated from a material having ordinary wear characteristics, and the cap is post treated to provide a wear resistant working surface 432. In one embodiment, a tungsten-carbide overlay is applied to the cap using a plasma transfer arc process. Advantageously, due to the high cost of providing a tungsten-carbide overlay, the overlay may be selectively applied to the tooth face 440 as shown by the shaded areas in FIG. 11. In this case the tooth back 442 remains un-hardened. Generally during operation, a majority of the wear occurs on the tooth face 440 and wear of the tooth back 442 is not significant. In one embodiment the thickness of the selectively applied tungsten-carbide layer is about 5 mm. In other embodiments, the wear resistant overlay may comprise chromium carbide.

Although specific embodiments of the invention have been described and illustrated, such embodiments should be considered illustrative of the invention only and not as limiting the invention as construed in accordance with the accompanying claims. Various modifications of form, arrangement of components, steps, details and order of operations of the embodiments illustrated, as well as other embodiments of the invention, will be apparent to persons skilled in the art upon reference to this description. It is therefore contemplated that the appended claims will cover such modifications and embodiments as fall within the true scope of the invention. In the specification including the claims, numeric ranges are inclusive of the numbers defining the range. Citation of references herein shall not be construed as an admission that such references are prior art to the present invention.

What is claimed is:

1. A screening disk for use on a roller of a roller screen for screening an ore feed, the roller screen having a plurality of adjacently located rollers, each adjacently located roller having a plurality of screening disks mounted in spaced apart relation on a shaft, the mounted screening disks being operable to intermesh with mounted screening disks on an adjacent roller of the roller screen to define interstices between respective mounted screening disks for permitting passage of sized ore portions through the roller screen, the screening disk comprising:

first and second opposing side working surfaces;

means for mounting the screening disk on a shaft of the roller for rotation therewith; and at least one of the first and second side working surfaces having a plurality of protrusions operable to extend outwardly into an interstice between the at least one side working surface and a side working surface of an adjacent mounted screening disk, the protrusions being operable to prevent oversize portions of ore passing through the interstice between the intermeshing screening disks; and wherein each protrusion is removably secured to the screening disk to facilitate replacement of the protrusion.

2. The screening disk of claim 1 wherein the protrusions each have a generally cylindrical shape.

3. The screening disk of claim 1 wherein each protrusion of the plurality of protrusions is dimensioned to provide sufficient clearance distance between the protrusion and the side working surface of the adjacent mounted screening disk to prevent contact between the protrusion and the side working surface when operating the roller screen.

4. The screening disk of claim 1 wherein the interstice between the at least one side working surface and the side working surface of the adjacent mounted screening disk has a dimension of about 50 to 60 millimeters and the clearance distance is in the range of about 10 millimeters.

5. The screening disk of claim 1 wherein the plurality of protrusions is disposed in spaced apart relation on the at least one side working surface.

6. The screening disk of claim 5 wherein the plurality of protrusions comprise a first plurality of protrusions disposed in spaced apart relation about a center of the at least one side working surface.

7. The screening disk of claim 6 wherein the first plurality of protrusions are disposed at a first radial distance from the center of the at least one side working surface and further comprising a second plurality of protrusions disposed in spaced apart relation about the center of the at least one side working surface, the second plurality of protrusions being disposed at a second radial distance from the center of the at least one side working surface.

8. The screening disk of claim 1 wherein each of the first and second opposing side working surfaces comprises plurality of protrusions extending outwardly therefrom.

9. The screening disk of claim 1 further comprising a third working surface extending between the first and second side working surfaces, the third working surface being operable to define an interstice between the third working surface and a shaft of an adjacent roller when mounted in the roller screen.

10. The screening disk of claim 9 wherein the third working surface comprises at least one removable cap disposed circumferentially on the screening disk.

11. The screening disk of claim 10 further comprising an opening bored through the screening disk between the first and second opposing side working surfaces, the opening being operable to receive a first fastener having a first threaded portion operable to receive a threaded portion of a second fastener for securing the at least one removable cap to the screening disk.

12. The screening disk of claim 1 wherein the means for mounting the screening disk on a shaft comprises a centrally located opening extending between the first and second opposing side working surfaces of the screening disk, the opening being operably configured to permit the screening disk to be received on the shaft and to engage the shaft for rotation therewith.

13. A screening disk for use on a roller of a roller screen for screening an ore feed, the roller screen having a plurality of adjacently located rollers, each adjacently located roller having a plurality of screening disks mounted in spaced apart relation on a shaft, the mounted screening disks being operable to intermesh with mounted screening disks on an adjacent roller of the roller screen to define interstices between respective mounted screening disks for permitting passage of sized ore portions through the roller screen, the screening disk comprising:

first and second opposing side working surfaces;

means for mounting the screening disk on a shaft of the roller for rotation therewith;

at least one of the first and second side working surfaces having a plurality of protrusions operable to extend outwardly into an interstice between the at least one side working surface and a side working surface of an adjacent mounted screening disk, the protrusions being operable to prevent oversize portions of ore passing through the interstice between the intermeshing screening disks;

a third working surface extending between the first and second side working surfaces, the third working surface being operable to define an interstice between the third working surface and a shaft of an adjacent roller when mounted in the roller screen wherein the third working surface comprises at least one removable cap disposed circumferentially on the screening disk.

14. The screening disk of claim 1 wherein each protrusion comprises a dowel pin operably configured to be received in respective openings in at least one of the first and second side working surfaces.

15. The screening disk of claim 14 wherein the protrusion and the dowel pin comprise a unitary body.

16. The screening disk of claim 14 wherein the dowel pin comprises a threaded portion operably configured to receive a fastener extending through a portion of the screening disk for removably securing the dowel pin in the opening.

17. The screening disk of claim 16 further comprising a third working surface extending between the first and second side working surfaces, the third working surface being operable to define an interstice between the third working surface and a shaft of an adjacent roller when mounted in the roller screen, and wherein:

the third working surface comprises at least one removable cap disposed circumferentially on the screening disk; and the fastener received in the threaded portion of the dowel pin extends through the removable cap and through the portion of the screening disk and is operable to secure the removable cap on the screening disk.

18. A roller for use in a roller screen for screening an ore feed, the roller comprising:

a shaft;

a plurality of screening disks mounted in spaced apart relation on the shaft, the screening disks being operable to intermesh with mounted screening disks on an adjacent roller of the roller screen to define interstices between respective mounted screening disks for permitting passage of sized ore portions through the roller screen; and at least one of the plurality of screening disks on the shaft comprising a screening disk as claimed in claim 1.

19. A roller screen for screening an ore feed, the roller screen comprising:

a plurality of adjacently located rollers, each roller comprising a shaft having a plurality of screening disks mounted in spaced apart relation on the shaft the mounted screening disks being operable to intermesh with mounted screening disks on an adjacent roller of the roller screen to define interstices between respective mounted screening disks for permitting passage of sized ore portions through the roller screen; and at least one of the screening disks on at least one of the rollers comprising a screening disk as claimed in claim 1.

20. The roller screen of claim 19 wherein each of the screening disks on the at least one roller comprises a protrusion extending outwardly from each of the first and the second side working surfaces and wherein an adjacent roller to the at least one of the adjacently located rollers comprises a plurality of screening disks that do not include protrusions.

* * * * *